US006315594B1

(12) United States Patent
Yanagida

(10) Patent No.: US 6,315,594 B1
(45) **Date of Patent: *Nov. 13, 2001**

(54) STRUCTURE FOR LOCKING ELECTRIC CONNECTORS

(75) Inventor: Munekazu Yanagida, Itami (JP)

(73) Assignee: Japan Solderless Terminal Manufacturing Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/151,800

(22) Filed: Sep. 11, 1998

(30) Foreign Application Priority Data

Sep. 17, 1997 (JP) ..... 9-272193

(51) Int. Cl.[7] ..... H01R 13/627
(52) U.S. Cl. ..... 439/357; 439/79
(58) Field of Search ..... 439/350–355, 439/357, 358, 79

(56) References Cited

U.S. PATENT DOCUMENTS 4,448,467 * 5/1984 Weidler ..... 439/357
4,449,767 * 5/1984 Weidler ..... 439/357
5,186,645 * 2/1993 Bixler ..... 439/358
5,342,215 * 8/1994 Silbernagel et al. ..... 439/357
5,380,217 * 1/1995 Yagi et al. ..... 439/358

* cited by examiner

*Primary Examiner*—Hien Vu
(74) *Attorney, Agent, or Firm*—Antonelli, Terry, Stout & Kraus, LLP

(57) ABSTRACT

Either of male and female connectors (1,2) fitting in or on each other has a housing (3) whose side face has a locking lug (5). The other connector has on a top of its housing (6) a lockable cantilever arm (13) corresponding to the lug, and a free end of the arm elastically deforming itself has a pawl (16) engageable with and disengageable from the lug (5). A tapered ridge (17) extends along and beside the arm (13) and is shaped such that its height gradually increases inwardly from the arm's portion near its basal end towards the free end of said arm. Any operator may insert a tool (30) having a flat and narrow bit in between the top **(6*a*) of the other connector's housing (6) and the ridge (17), from this housing's side where the basal end is located so that the tool's bit will force outwards the free end of the arm (13) until its pawl (16) is disengaged and unlocked from the lug (5)**.

3 Claims, 3 Drawing Sheets

STRUCTURE FOR LOCKING ELECTRIC CONNECTORS

BACKGROUND OF THE INVENTION

1. Field of the Invention

The present invention relates to a locking structure formed integral with a pair of male and female electric connectors, wherein the male connector is capable of fitting at least partly in the female one to be locked in position.

2. Prior Art

In most prior art locking structures, either of a male connector and a female connector fitting in and engageable with each other comprises a housing whose side face is formed to have a locking lug. The other connector comprises a lockable cantilever arm corresponding to the locking lug, and an end of the cantilever arm capable of elastically swaying has a pawl engageable with and disengageable from the locking lug.

When unlocking such known structures, the operator has to pick up the cantilever arm with his or her fingers and/or with aid of a special tool so as to cause the end of the arm to temporarily swing outwards. Thus, releasing the pawl from the locking lug on demand has required a long time and much labor.

SUMMARY OF THE INVENTION

The present invention was made to resolve those problems in the prior art. Therefore, it is an object of the present invention to provide a novel locking structure for a pair of mating connectors that can be unlocked from each other if the operator just inserts any simple tool such as a screwdriver whose flat and narrow bit is '-(minus)'-shaped.

According to the present invention, either of a male connector and a female connector fitting in or on each other comprises, as usual, a housing whose side face is formed to have at least one locking lug. The other connector also comprises, as usual, on a top of its housing at least one lockable cantilever arm corresponding to the locking lug, and a free end of the cantilever arm capable of elastically swaying has a pawl engageable with and disengageable from the locking lug. However, it is a characteristic feature of the locking structure provided herein that a tapered ridge extends along and beside the cantilever arm and this ridge is shaped such that its height gradually increases inwardly towards the top of the other connector's housing as the ridge extends from the cantilever arm's portion near its basal end towards the free end of said arm. By virtue of this feature, any operator may insert a simple tool having a flat and narrow bit in between the top of the other connector's housing and the tapered ridge, from this housing's side where the basal end is located, when he or she wants to separate the connectors from each other. In detail, due to a wedge-like function of the tapered ridge, the tool's flat and narrow bit will force outwards the free end until its pawl is disengaged and unlocked from the locking lug.

Preferably, two locking lugs formed on one of the connectors are disposed side by side and spaced apart from each other, and correspondingly, two lockable cantilever arms are formed on the other connector. Further, it is also desirable that these cantilever arms have their portions located adjacent to the free ends and integrally connected to each other by a tie-bridge disposed between them, and the tapered ridge protrudes from an inner side of this tie-bridge.

THE PREFERRED EMBODIMENTS

Figure 1:
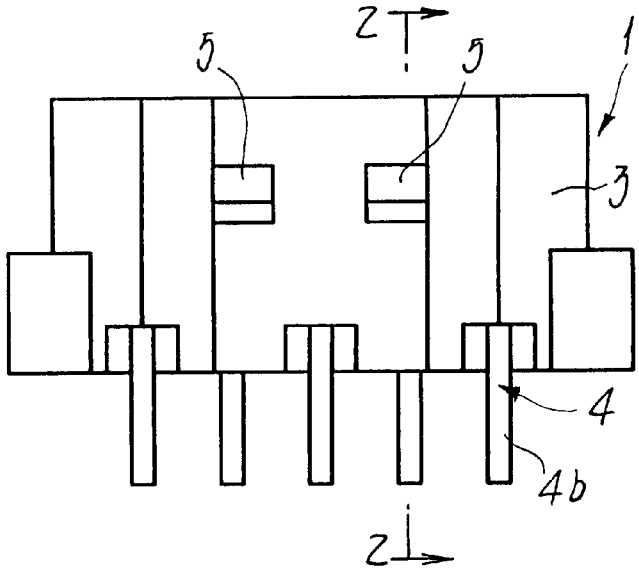
FIG. 1 is a rear elevation of a male connector whose parts constitute a locking structure provided herein.

Some preferable embodiments of the present invention will now be described in detail referring to the drawings.

Figure 2:
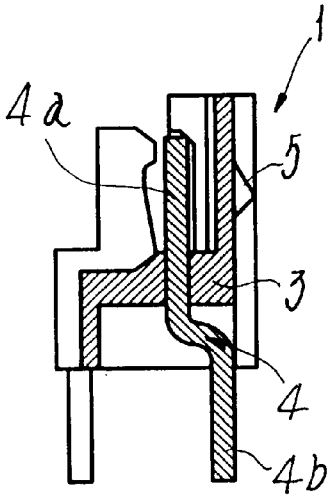
FIG. 2 is a cross sectional view taken along the line 2—2 in FIG. 1.

FIGS. 1 and 2 show a male connector 1 whose parts constitute a locking structure provided by the present invention. Similarly, FIGS. 3 and 4 show a female connector 2 that also comprises parts constituting the locking structure.

The male connector 1 comprises a base housing 3 made of a Nylon (registered trademark) or the like insulating material. A plurality of post contacts 4 are fixed to and through the base housing 3. A head 4*a* of each post contact 4 is intended to fit in one of socket contacts described below. A leg 4*b* of said contact 4 is to be electrically connected to a printed circuit board that will also be discussed below. Locking lugs 5 are mountain-shaped protuberances jutting from an outer side of the base housing 3. Those two lugs 5 are disposed side by side and spaced apart from each other.

Figure 3:
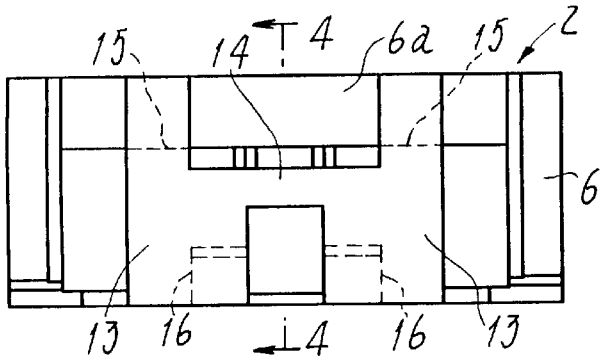
FIG. 3 is a plan view of a female connector whose parts also constitute the locking structure.
Figure 4:
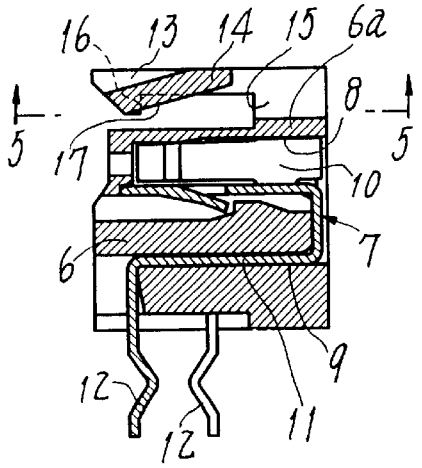
FIG. 4 is a cross section taken along the line 4—4 in FIG. 3.
Figure 5:
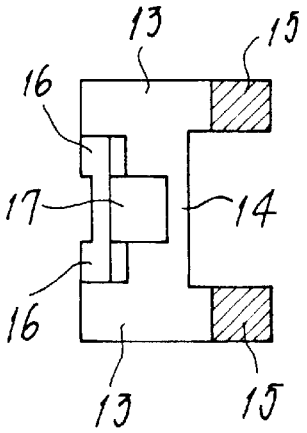
FIG. 5 is a cross section taken along the line 5—5 in FIG. 4.

As seen in FIGS. 3, 4, and 5 the female connector 2 comprises a socket housing 6 also made of a Nylon (registered trademark) or the like insulating material. A plurality of socket contacts 7 are held in place in the socket housing and each protruding in part therefrom, and are arranged side by side at the same pitch as the post contacts 4 of the male connector 1. A row of compartments 8, is formed in the housing 6 so as to accommodate socket bodies 10 of the socket contacts 7. Flat and elongate slots 9 which the socket contacts' leads 11 penetrate are also formed in this housing 6, in parallel with and below the compartments 8. Each socket contact 7 is made by punching and pressing a thin phosphor bronze sheet and has the body 10 and the lead 11. The lead 11 continuing from a rear end of the socket body 10 held in one of the compartments 8 is bent twice to fit in the slot 9 and further bent once more to provide a leg 12 protruding downward from the housing 6. Those legs 12 are intended to be connected to another printed circuit board that will be mentioned again. On the other hand, the housing 6 has a top 6*a* from which two lockable arms 13 protrude. These arms 13 are spaced from each other a distance generally corresponding to the two spaced locking lugs 5. A tie-bridge 14 extending between those arms 13 is integral with portions thereof adjacent to their free ends. Thus, the lockable arms 13 each having a thick basal end 15 continuing from the top 6*a* are of a cantilever shape in that the free end portions united together with the tie-bridge 14 can elastically swing up and down (viz., towards and away from the top 6*a*) an angle around the basal ends 15. Two pawls 16, that are inward protuberances from the free ends of those lockable arms 13 as seen in FIG. 5, will engage with the locking lugs 5 of the male connector 1 when it fits in this female connector. The tie-bridge 14 has an inner side where a tapered ridge 17 is formed as a protuberance of said tie-bridge. The gap between the inner face of the ridge 17 and the top of housing 6 gradually reduces towards the ridge's end near the arms' free ends.

Figure 6:
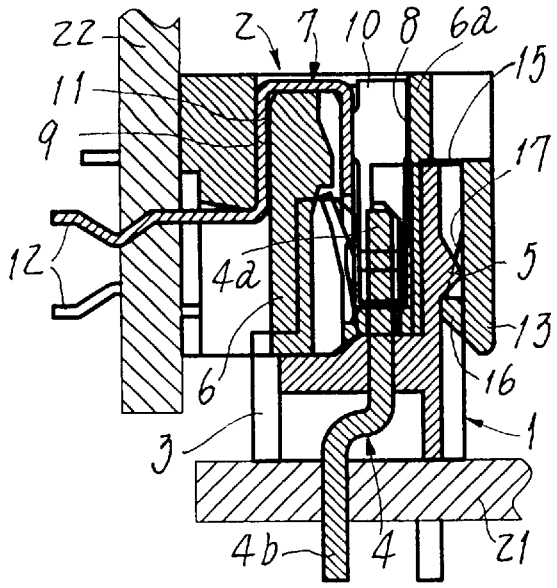
FIG. 6 is a side elevational cross section of the male and female connectors that are respectively surface-mounted on printed circuit boards and are locked one in another.

FIG. 6 shows the male connector 1 surface-mounted on the one printed circuit board 21 and mating with the female connector 2 also surface-mounted on the other printed circuit board 22. The head 4*a* of each post contact 4 fits in the socket body 10 of the corresponding socket contact 7, whereby these contacts 4 and 7 are electrically connected one to another. Both the pawls 16 of the lockable arms 13 engage with the locking lugs 5 of the male connector 1 so as to retain it in the female connector 2.

Figure 7:
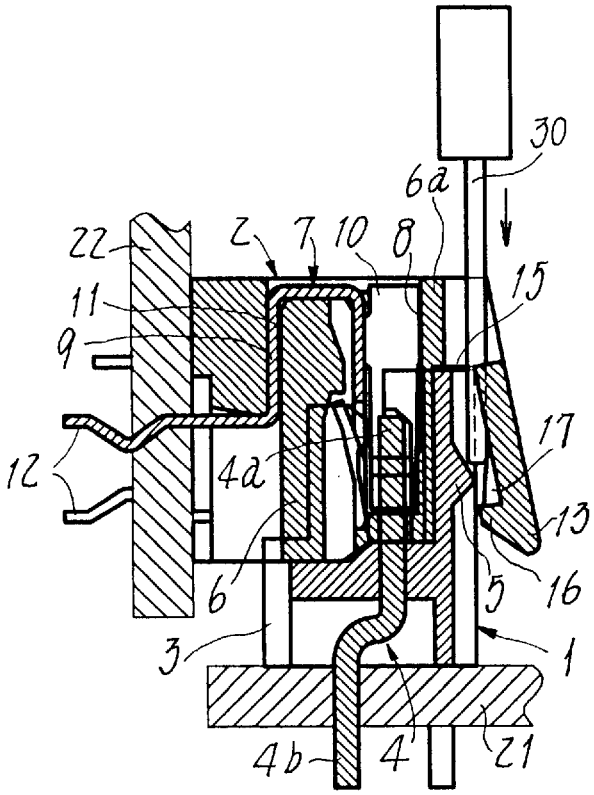
FIG. 7 is a cross section corresponding to FIG. 6, but with the connectors unlocked relative to each other.

In such a mutually-locked state of the connectors, an elongate simple tool 30 whose bit is narrow and flat like a '-(minus)'-shaped screwdriver may be inserted in between the top 6*a* of socket housing 6 and the tie-bridge 14 in a manner as shown in FIG. 7. As the tool's bit advances inwards and along the tapered ridge 17, it will function like a kind of wedge to urge outwards the tie-bridge 14 together with the free end portions of lockable arms 13. Due to this elastic movement of the lockable arms, the pawls 16 will disengage from the locking lugs 5 to thereby unlock the connectors from each other. In this state of the relevant members, the female connector 2 can be lifted easily away from the male connector 1.

In the embodiment described above, two locking lugs 5 are spaced sideways apart from each other corresponding to the two lockable arms 13. However, it will be apparent that one such lug 5 engaging a single lockable arm will suffice in the present invention. In this case, a pawl 16 and a tapered ridge 17 may be juxtaposed side by side on a free end portion of the single arm 13.

In summary, the tapered ridge simply disposed along and beside the at least one elastically swaying lockable arm is effective to easily and instantly unlock the connectors from each other, by just inserting a flat and narrow tool end. In between them from the side where the basal end of said arm is located.

What I claim is:

1. A structure for locking male and female electric connectors to each other comprising:

a first housing having at least a first contact including a first leg therein for one of the male and female connectors;

at least one locking lug formed on and integral with a side face of the first housing;

a second housing having at least a second contact including second leg therein for the other of the male and female connectors;

at least one lockable cantilever arm formed on and integral with a top of the second housing at a position corresponding to a position of the locking lug when the male and female connectors are connected to each other, the cantilever arm capable of elastically swaying away from the second housing and having a free end and a basal end, the basal end being attached to a remainder of the second housing, and further having a pawl on one side of the cantilever arm adjacent to the free end and engageble with and disengageable from the locking lug; and a tapered ridge extending inwardly beside and along the cantilever arm;

wherein a gap between the tapered ridge and the remainder of the second housing gradually decreases as the ridge extends from a portion near the basal end towards the free end, wherein at least a portion of the tapered ridge is provided adjacent the pawl such that a portion of the pawl and a portion of the tapered ridge are provided side by side at a predetermined distance from the basal end, whereby a flat and narrow tool end is capable of being inserted in between the tapered ridge and the top of the second housing from a rear end of basal end to the free end, so as to sway the arm outwardly so that the free end thereof is displaced outwards until the pawl is disengaged and unlocked from the locking lug.

2. A structure as defined in claim 1, wherein two locking lugs are formed on the first housing side by side and spaced apart from each other, and two lockable cantilever arms are formed on the second housing at positions corresponding to the positions of the two lugs when the male and female connectors are connected to each other, and wherein the two cantilever arm have their portions located adjacent to the free ends and integrally connected to each other by a tie-bridge formed integral with and disposed between the portions so that the tapered ridge protrudes from an inner side of the tie-bridge.

3. A structure as defined in claim 1, wherein the first housing includes at least one male connector and the second housing includes at least one female connector.

* * * * *